US008210104B2

(12) United States Patent
Funk et al.

(10) Patent No.: US 8,210,104 B2
(45) Date of Patent: Jul. 3, 2012

(54) MOVEABLE PRINTING PLATE REGISTRATION MEMBER

(75) Inventors: John Funk, Delta (CA); Jo Anna L. Gromadzki, Vancouver (CA); Aleksandar Tegzes, Vancouver (CA); Peter Hawes, Burnaby (CA)

(73) Assignee: Eastman Kodak Company, Rochester, NY (US)

( * ) Notice: Subject to any disclaimer, the term of this patent is extended or adjusted under 35 U.S.C. 154(b) by 923 days.

(21) Appl. No.: 12/256,501

(22) Filed: Oct. 23, 2008

(65) Prior Publication Data

US 2010/0101439 A1 Apr. 29, 2010

(51) Int. Cl.

| | |
|---|---|
| ***B41F 27/10*** | (2006.01) |
| ***B41F 21/00*** | (2006.01) |
| ***B65H 9/10*** | (2006.01) |

(52) U.S. Cl. ..... 101/486; 101/481; 101/477

(58) Field of Classification Search ..... 101/477, 101/481, 485, 486, 483

See application file for complete search history.

(56) References Cited

U.S. PATENT DOCUMENTS

| | | | | |
|---|---|---|---|---|
| 5,889,547 | A | 3/1999 | Rombult et al. | |
| 6,097,475 | A | 8/2000 | Jakul et al. | |
| 6,510,793 | B1 | 1/2003 | Kerr et al. | |
| 6,662,725 | B1 | 12/2003 | Koizumi et al. | |
| 6,755,132 | B1 | 6/2004 | Cummings | |
| 2002/0102120 | A1 | 8/2002 | Kaya et al. | |
| 2004/0099165 | A1 * | 5/2004 | Hashiguchi | 101/477 |

FOREIGN PATENT DOCUMENTS

| | | | |
|---|---|---|---|
| EP | 1 357 071 | A2 | 10/2003 |
| EP | 1 980 510 | A1 | 10/2008 |

* cited by examiner

*Primary Examiner* — Leslie J Evanisko
(74) *Attorney, Agent, or Firm* — Nelson Adrian Blish

(57) ABSTRACT

A method for registering a printing plate includes supporting the printing plate on a support surface. A plurality of registration members adapted to register an edge of the printing plate is provided. The first printing plate is moved over the support surface along a first direction to a position where the edge of the printing plate contacts a first registration member of the plurality of registration members. The first registration member is moved along a second direction that intersects the first direction while maintaining contact between the first registration member and the edge of the printing plate at a location on the edge that does not substantially vary as the first registration member moves along the second direction. Contact is established between the printing plate and a second registration member of the plurality of registration members after the first registration member has commenced moving along the second direction.

7 Claims, 10 Drawing Sheets

MOVEABLE PRINTING PLATE REGISTRATION MEMBER

CROSS REFERENCE TO RELATED APPLICATIONS

Reference is made to commonly-assigned U.S. patent application Ser. No. 12/256,510 (now U.S. Publication No. 2010/0101440), filed Oct. 23, 2008, entitled PRINTING PLATE POSITION, by Funk et al., the disclosure of which is incorporated herein.

FIELD OF THE INVENTION

The invention relates to printing and in particular to registering printing plates in an imaging system such as a computer-to-plate system.

BACKGROUND OF THE INVENTION

Contact printing using high volume presses is commonly employed to print a large number of copies of an image. Contact printing presses utilize printing plates to sequentially apply colorants to a surface to form an image thereon. The surface can form part of a receiver medium (e.g. paper) or can form part of an intermediate component adapted to transfer the colorant from its surface to the receiver medium (e.g. a blanket cylinder of a press). In either case, a colorant pattern is transferred to the receiver medium to form an image on the receiver medium.

Printing plates typically undergo various processes to render them in a suitable configuration for use in a printing press. For example, exposure processes are used to form images on an imageable surface of a printing plate that has been suitably treated so as to be sensitive to light or heat radiation. One type of exposure process employs masks. The masks are typically formed by exposing highly sensitive film media using a laser printer known as an "image-setter." The film media can be additionally developed to form the mask. The mask is placed in area contact with a sensitized printing plate, which is in turn exposed through the mask. Printing plates exposed in this manner are typically referred to as "conventional printing plates." Typical conventional lithographic printing plates are sensitive to radiation in the ultraviolet region of the light spectrum.

Another conventional method directly forms images on printing plates through the use of a specialized imaging apparatus typically referred to as a plate-setter. A plate-setter in combination with a controller that receives and conditions image data for use by the plate-setter is commonly known as a "computer-to-plate" or "CTP" system. CTP systems offer a substantial advantage over image-setters in that they eliminate film masks and associated process variations associated therewith. Printing plates imaged by CTP systems are typically referred to as "digital" printing plates. Digital printing plates can include photopolymer coatings (i.e. visible light plates) or thermo-sensitive coatings (i.e. thermal plates).

In order to provide printed materials of suitable quality during a printing operation, the images formed on the printing plate must be accurately registered. Typically, in computer-to-plate imaging systems, one or more edges of a printing plate are used for registration purposes during the formation of the images. For example, during an image forming procedure, a printing plate is aligned on an imaging support surface of a computer-to-plate system by bringing one of its edges known as a "registration edge" into contact with various registration members. Conventional computer-to-plate registration systems typically have a number of registration pins or stops fixedly attached to the imaging support surface. Various groupings of fixed registration pins are often employed to register printing plates of different sizes or to register multiple printing plates.

Although these conventional fixed pin registration systems are relatively simplistic in nature, various problems are associated with them. For example, limited surface contact between a printing plate's registration edge and the fixed pins is usually established as the printing plate is moved into engagement with the pins. Ever increasing throughput demands placed on the computer-to-plate system require that the printing plate be conveyed with increasing speeds. These increased conveyance speeds can increase loading conditions between the printing plate's registration edge and the fixed pins and impart deformations or other damage onto the registration edge of the printing plate.

Edge deformations or damage can lead to various problems. For example, once the printing plate is registered against the registration pins it is imaged typically in accordance with various offsets from the various printing plate edges. Deformations such as small dents in the vicinity of the contacted registration pins can cause shifts in a desired image placement with respect to the registration edge. Additional printing plate preparation steps can include punching and bending procedures which are used to impart various features onto the printing plates to facilitate the mounting and registration of the printing plates on press. If these features are added by equipment that uses a registration system that engages with deformed areas of the registration edge, the desired positioning of these features can be adversely impacted. In some systems, punching capabilities are incorporated in the computer-to-plate system itself.

Other factors can also lead to the formation of deformations on various edges of a printing plate. For instance, there is an increasing demand for computer-to-plate systems that can accommodate larger plate sizes. The increased size and weight associated with these larger printing plates requires larger conveyance forces to move the printing plate into engagement with conventional registration pin systems. These increased forces can further lead to the formation of registration edge deformations.

Thus, there is a need for an imaging apparatus with improved plate registration capabilities. There is also a need for a computer-to-plate imaging system adapted to improve the positioning printing plates to form images accurately thereon. In addition, there is a need for a computer-to-plate system with a printing plate registration system that reduces the potential to form undesired deformations on the edges of printing plates during the handling thereof.

SUMMARY OF THE INVENTION

Briefly, according to one aspect of the present invention a method for registering a printing plate includes supporting the printing plate on a support surface. A plurality of registration members adapted to register an edge of the printing plate is provided. The first printing plate is moved over the support surface along a first direction to a position where the edge of the printing plate contacts a first registration member of the plurality of registration members. The first registration member is moved along a second direction that intersects the first direction while maintaining contact between the first registration member and the edge of the printing plate at a location on the edge that does not substantially vary as the first registration member moves along the second direction. Contact is established between the printing plate and a second registration member of the plurality of registration members after the first registration member has commenced moving along the second direction.

BRIEF DESCRIPTION OF THE DRAWINGS

Embodiments and applications of the invention are illustrated by the attached non-limiting drawings. The attached drawings are for purposes of illustrating the concepts of the invention and may not be to scale.

DETAILED DESCRIPTION OF THE INVENTION

Figure 1:
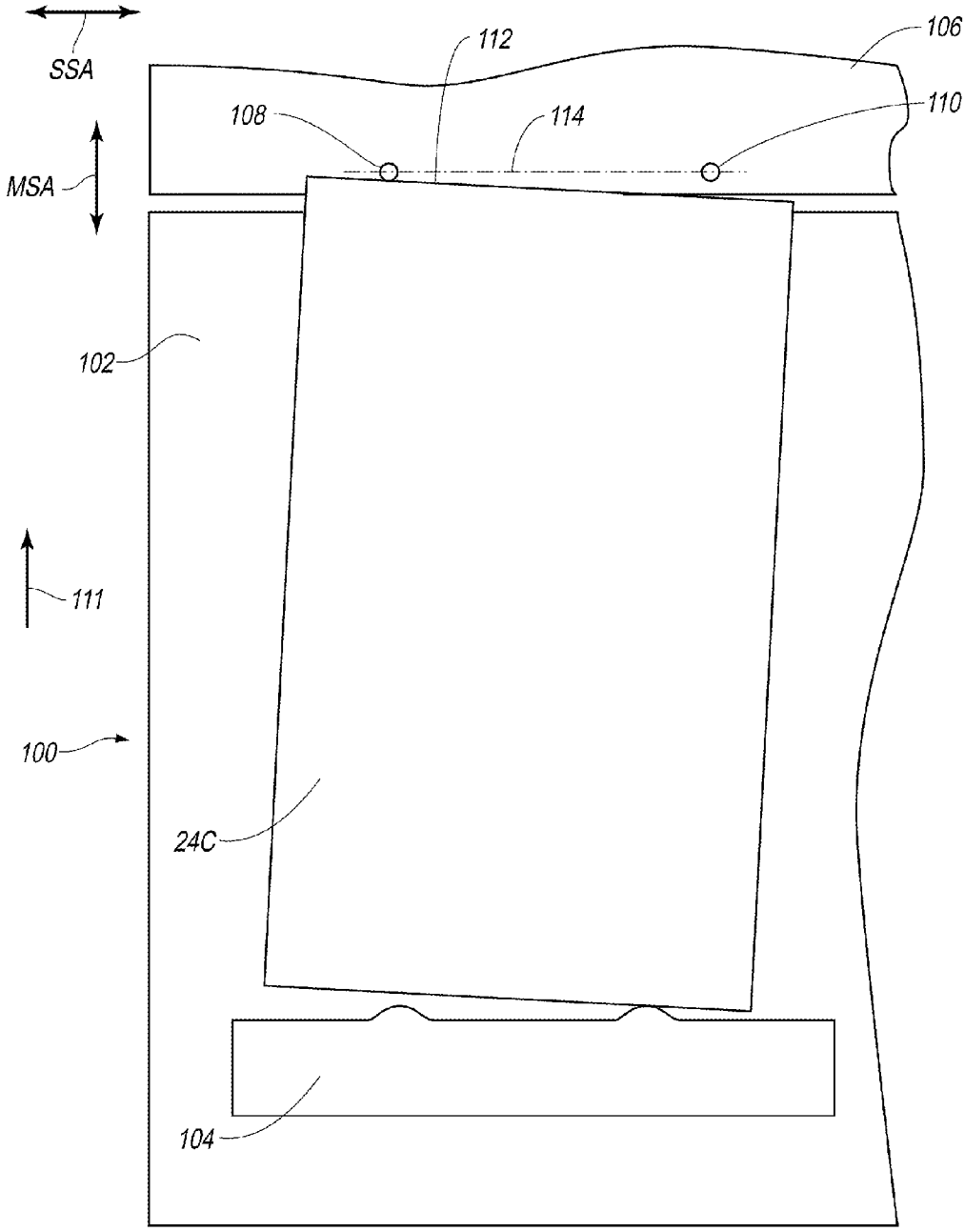
FIG. 1 PRIOR ART
FIG. 1 shows a prior art conventional printing plate positioning apparatus.

Throughout the following description specific details are presented to provide a more thorough understanding to persons skilled in the art. However, well-known elements may not have been shown or described in detail to avoid unnecessarily obscuring the disclosure. Accordingly, the description and drawings are to be regarded in an illustrative, rather than a restrictive sense.

FIGS. 3-6 schematically illustrate a printing plate imaging apparatus 10 as per an example embodiment of the invention. In the embodiment of FIGS. 3-6, imaging apparatus 10 is a computer-to-plate imaging apparatus. Imaging apparatus 10 comprises a frame 12 supporting an image recording system 14, a support surface 90, a plate exchange surface 17, a transfer support surface 60, a punch system 19, and a controller 20.

Controller 20 can comprise a microprocessor such as a programmable general purpose microprocessor, a dedicated micro-processor or micro-controller, or any other system that can receive signals from various sensors, and from external and internal data sources and that can generate control signals to cause actuators and motors within imaging apparatus 10 to operate in a controlled manner to form imaged printing plates 24.

Image recording system 14 comprises an imaging head 22 adapted to take image-forming actions within an image forming area of an imaging support surface 28 so that an image can be formed on each of one or more printing plates 24 loaded within the image forming area on imaging support surface 28. In the embodiment illustrated, the plurality of printing plates 24 loaded on imaging support surface 28 comprises a first printing plate 24A and a second printing plate 24B. However, this is not limiting and in other embodiments imaging support surface 28 may be capable of holding a different number of printing plates 24 in a manner that allows imaging head 22 to form images on each of printing plates 24 held thereby. First and second printing plates 24A and 24B can include different sizes or substantially the same size as shown in the illustrated embodiment.

Imaging head 22 generates one or more modulated light beams or channels that apply image modulated energy onto first and second printing plates 24A and 24B. Imaging head 22 can move along a sub-scanning axis SSA while a motor 36 or other actuator moves the imaging support surface 28 along a main scanning axis MSA such that image forming actions can be taken over an image forming area of imaging support surface 28 on which first and second printing plates 24A and 24B are located.

Imaging head 22 is illustrated as providing two light emission channel sources 30 and 32 which can each comprise, for example, a source of laser light and laser modulation systems of a kind known to those of skill in the art (not illustrated) each capable of taking image forming actions on printing plates 24 located within the image forming area. In some embodiments, light emission channel sources 30 and 32 can be independently controlled, each source applying modulated energy to first and second printing plates 24A and 24B. In yet other embodiments of this type, a single light emission channel source can be used to generate a modulated light beam that can be directed across the entire image forming area.

In various embodiments, not illustrated, various types of imaging technology can be used in imaging head 22 to form an image pattern on first and second printing plates 24A and 24B. For example and without limitation, thermal printing plate image forming techniques known to those of skill in the art can be used. The choice of a suitable light emission source can be motivated by the type of printing plate 24 that is to be imaged.

In the embodiment of FIGS. 3-6, imaging support surface 28 illustrates an external drum type of imaging surface having a generally cylindrical exterior surface 34. Accordingly in the embodiment of FIG. 4, main scanning axis MSA is illustrated as extending along an axis that is parallel to a direction of rotation of exterior surface 34. However, in other embodiments imaging support surface 28 can comprise an internal drum or a flatbed. In the external drum embodiment illustrated, first and second printing plates 24A and 24B are held on exterior surface 34 by clamping forces, electrostatic attraction, vacuum force or other attractive forces supplied respectively by plate clamps, electrostatic systems, vacuum systems or other plate attracting systems (not illustrated).

During imaging operations, controller 20 causes image modulated beams of light from imaging head 22 to be scanned over the imaging forming area by a combination of operating a main scanning motor 36 to rotate imaging support surface 28 along main scanning axis MSA and translating imaging head 22 in the sub-scanning direction by causing rotation of a threaded screw 38 to which light emission channel sources 30 and 32 are attached in a manner that causes them to advance in a linear fashion down the length of threaded screw 38 as threaded screw 38 is rotated. In some embodiments, light emission channel sources 30 and 32 can be controlled to move independently of one another along sub-scanning axis SSA. Other mechanical translation systems known to those of skill in the art can be used for this purpose. Alternatively, other well-known light beam scanning systems, such as those that employ rotating mirrors, can be used to scan image modulated light across the image forming area of imaging support surface 28.

Imaging apparatus 10 has a transfer support surface 60 and a positioning system 62. Transfer support surface 60 is sized to receive, hold and/or deliver a plurality of printing plates 24 at the same time. In this example embodiment, positioning system 62 is connected between frame 12 and transfer support surface 60 and defines a movement path for transfer support surface 60 between a transfer position shown in FIG. 5 and a second position shown in FIG. 6. In this illustrated embodiment, printing plates 24 can be transferred after they are imaged by imaging head 22. In this illustrated embodiment, transferred printing plates 24 can be punched at the second position by punch system 19. In other embodiments of the invention, printing plates 24 can be transferred to other systems for other processing.

Figure 4:
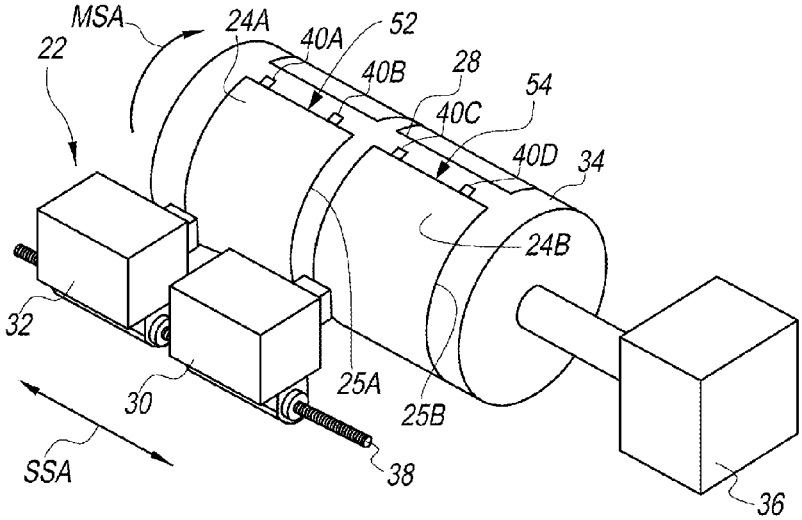
FIG. 4 shows a perspective view of an imaging head and imaging support surface of a type useful with the imaging apparatus of FIG. 3.
Figure 5:
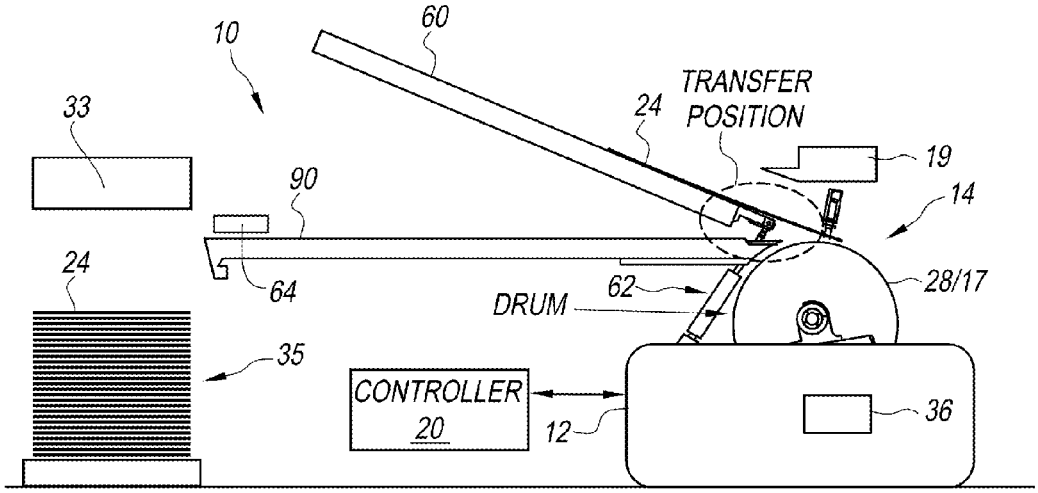
FIG. 5 shows a side view of the imaging apparatus of FIG. 3 with transport support surface in a transfer position.
Figure 6:
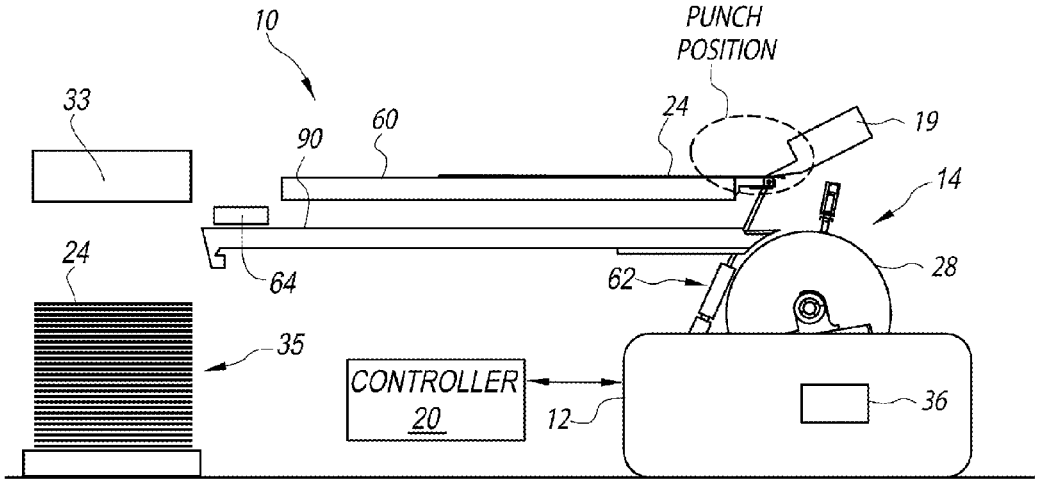
FIG. 6 shows a side view of the imaging apparatus of FIG. 3 with the transport support surface in a punch position.

As schematically shown in FIG. 4, a set including a first registration member 40A and a second registration member 40B, and a set including a first registration member 40C and a second registration member 40D are associated respectively with first and second printing plates 24A and 24B which are positioned against their associated registration members during an imaging operation.

First and second registration members 40A and 40B are arranged to help control the position of registration edge 52 of first printing plate 24A along main scanning axis MSA. Registration members 40C and 40D are arranged to help control the position of registration edge 54 of second printing plate 24B along main scanning axis MSA. Alignment along sub-scanning axis SSA in either case can be provided in various ways. In a preferred embodiment, imaging head 22 has an integral edge detector (not shown) that is adapted to sense lateral edges 25A and 25B of first and second printing plates 24A and 24B as imaging head 22 is moved past the printing plates during imaging operations. Controller 20 receives signals from the edge detector and adjusts imaging operations so that images are formed on first and second printing plates 24A and 24B in precise relation to the sensed lateral edges 25A and 25B of first and second printing plates 24A and 24B respectively. Typically, integral edge detectors include an optical sensor that detects an edge based upon differences in an amount of light reflected thereby. However, integral edge detectors can take other forms known to those of skill in the art including magnetic field detectors, electrical sensors, and contact detectors.

In the embodiment illustrated, a support surface 90 is provided and is adapted to exchange various printing plates 24 (e.g. first and second printing plates 24A and 24B) with imaging support surface 28. Printing plates 24 can be provided to support surface 90 for subsequent transfer to imaging support surface 28 in various ways. For example, plate handling mechanism 33 can be used to pick each printing plate 24 from one or more printing plate stacks 35 and transfer each printing plate 24 to support surface 90 by various methods as are well known in the art. Printing plate stacks 35 can be arranged or grouped in various manners, including by plate size, type, etc. Cassettes, pallets and other containing members are regularly employed to group a plurality of printing plates 24. The printing plates 24 in printing plate stack 35 are shown separated from one another for clarity.

Once a printing plate 24 is transferred to support surface 90, a plate positioning system 64 is operated to engage with a surface of the printing plate 24 and move it at least in part from support surface 90 onto imaging support surface 28. In this regard, it is desired that the printing plate 24 be transferred to imaging support surface 28 such that one of its edges is in contact and aligned with each of an associated set of registration members.

FIG. 1 schematically shows a conventional printing plate positioning apparatus 100 employing a support surface 102, a plate positioning system 104, and an imaging support surface 106 to which a set of fixed registration pins 108 and 110 are attached. Main-scanning axis MSA and sub-scanning axis SSA are oriented in a similar fashion as previously described. In this case, plate position system 104 is adapted to engage a surface of a printing plate 24C and move printing plate 24C along a direction 111 that is substantially parallel to a main-scanning axis MSA. In this case, the engaged surface of printing plate 24C is an edge surface of printing plate 24C. Registration pins 108 and 110 are fixedly attached to imaging support surface 106 such that they are positioned along a registration pin axis 114 that is substantially parallel to sub-scanning axis SSA. A registration edge 112 of printing plate 24C is to be positioned against both of registration pins 108 and 110. In this case, registration edge 112 is a leading edge of printing plate 24C (i.e. as defined with direction of movement of printing plate 24C). Simultaneous contact between each of the registrations pins 108 and 110 and registration edge 112 is seldom achieved since registration edge 112 often assumes a skewed orientation with registration pin axis 114. This skewed orientation can occur for various reasons. For example printing plate 24C may be initially positioned on support surface 102 with a skewed orientation. Additionally or alternatively, printing plate 24C may assume a skewed orientation as it is moved on support surface 102. Improper manufacture of the printing plate 24C (e.g. incorrectly sheared printing plate material stock) can also lead to skewed orientations. Additionally, the registration pin axis 114 of many conventional computer-to-plate systems is often skewed with respect to sub-scanning axis SSA. For example, as described in U.S. Pat. No. 6,755,132 (Cummings), the registration pin axis of each of a plurality of sets of registration pins can be made to assume different orientations to accommodate different sized printing plates. Those skilled in the art will realize that other factors can lead to skewed orientations.

Regardless of the reason for the skewed orientation, printing plate 24C is brought into register with registration pins 108 and 110 by engaging one of the registration pins 108 and 110 first and then pivoting about the engaged registration pin to engage the other one of registration pins 108 and 110. Typically, plate positioning system 104 continues to move printing plate 24C as it pivots about one of the two registration pins 108 and 110. In this illustrated case, printing plate 24C pivots about a point of contact with registration pin 108. In this regard, the point of contact acts as a pivot point about which the printing plate 24C pivots about on support surface 102. As a printing plate 24 is pivoted about a given pivot point, the pivoting motion can cause the speed of various portions of printing plate 24C relative to support surface 90 to vary from one another. The pivoting dependant speed is referred to as the "pivoting speed." The pivoting speed of various portions of printing plate 24C will be related to a distance from the pivot point to a location of each of the portions and the angular speed (i.e. typically expressed in units of radians/sec) with which printing plate 24C is pivoted about the pivot point. Accordingly, portions of the printing plate 24 positioned further from the pivot point will have higher pivoting speeds than portions of the printing plate 24 that are positioned closer to the pivot point. When a pivot point is directly located on a printing plate 24, the location of the pivot point will correspond to a location of a portion of the printing plate 24 that has substantially a null pivoting speed as the printing plate 24 pivots.

The present invention has determined that relatively large frictional moments between printing plate 24C and support surface 102 are required to be overcome to permit a conventional pivoting movement about a registration pin such as shown in FIG. 1. This effect is simulated by the force diagram shown in FIG. 2 in which printing plate 24C is pivoted about a registration pin 108 which acts as a pivot point 116 positioned at a point on the perimeter of the printing plate 24C in proximity to a corner portion 118 of printing plate 24C. Again, a large portion of printing plate 24C is supported on support surface 102. The forces applied to printing plate 24C include a reaction force $R_A$ exerted by registration pin 108 on an edge portion of printing plate 24C as well as a plate movement force $F_A$ (e.g. as provided by plate positioning system 104). Force $F_A$ is applied to an edge portion of printing plate 24C in proximity to a corner portion 120 to provide a moment to pivot printing plate 24C about pivot point 116. In this case, corner portion 120 opposes corner portion 118.

Frictional characteristic between printing plate 24C and support surface 102 can be simulated by dividing printing plate 24C into fifteen (15) frictional cells 122 shown in broken lines. The number of frictional cells 122 employed in this simulation are selected for illustration purposes only and those skilled in the art will realize that different numbers can also be employed. Portions of printing plate 24C corresponding to each friction cell 122 are assumed to contact support surface 102 in a uniform manner and a frictional force $F_{FA}$ associated with each friction cell 122 can be estimated by the following relationship:

$$F_{FA}=\mu*\rho*L*W*b*g;\text{where:} \quad (1)$$

μ is coefficient of friction associated with printing plate 24C and support surface 102;

ρ is the mass density of printing plate 24;

L is a first size of each frictional cell 122;

W is a second size of each frictional cell 122;

b is a thickness of printing plate 24C; and g is a gravitational acceleration constant.

In this case, the frictional force acting on each frictional cell is determined to be $F_{FA}$=0.0573 N for the following conditions: μ=0.3, ρ=2700 kg/m$^3$, L=W=0.19 m, b=0.0002 m and g=9.81 ms/$^2$.

Figure 2:
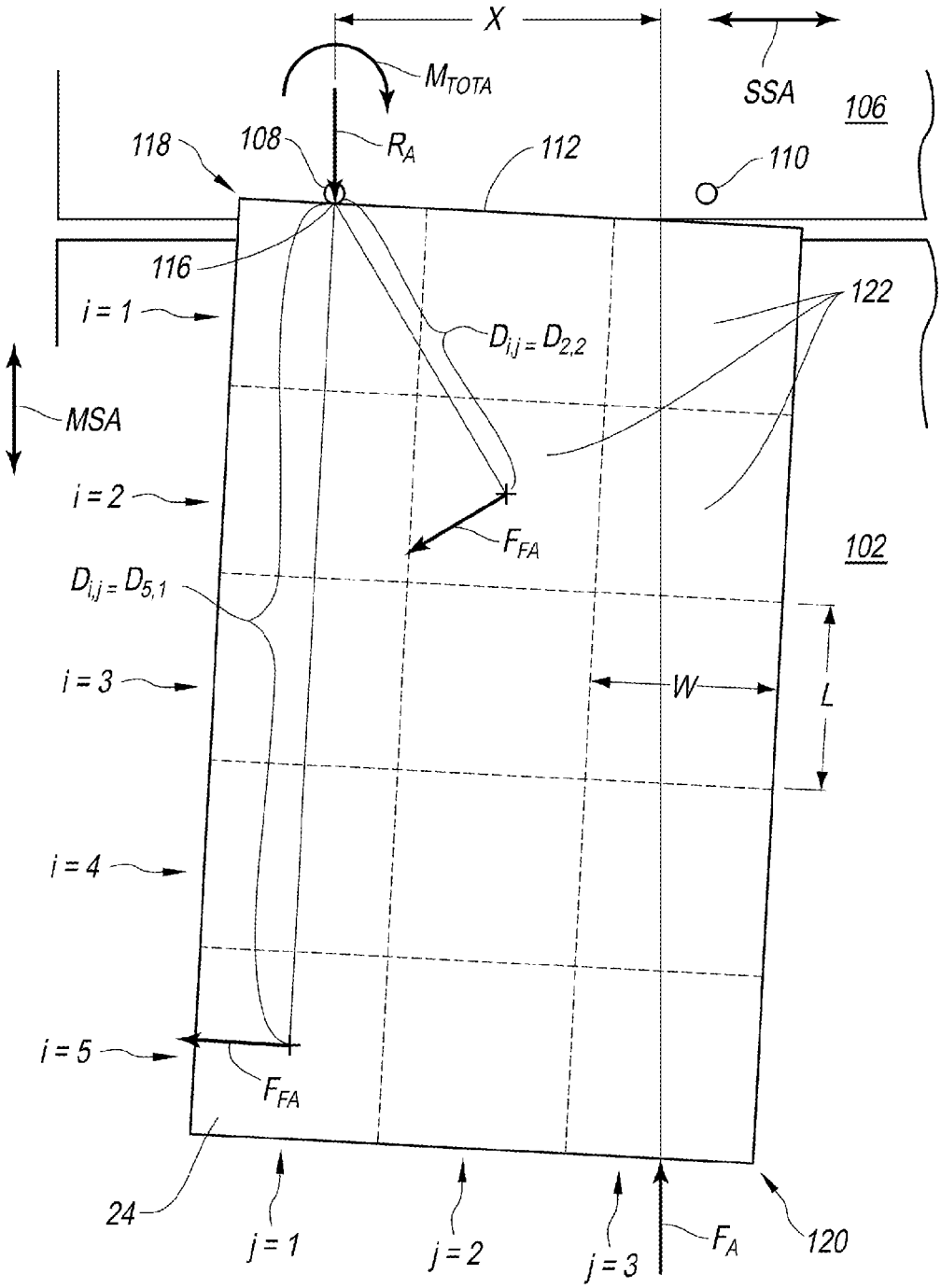
FIG. 2 PRIOR ART
FIG. 2 shows a prior art force diagram associated with the positioning of a printing plate in the conventional printing plate positioning apparatus of FIG. 1.
Figure 3:
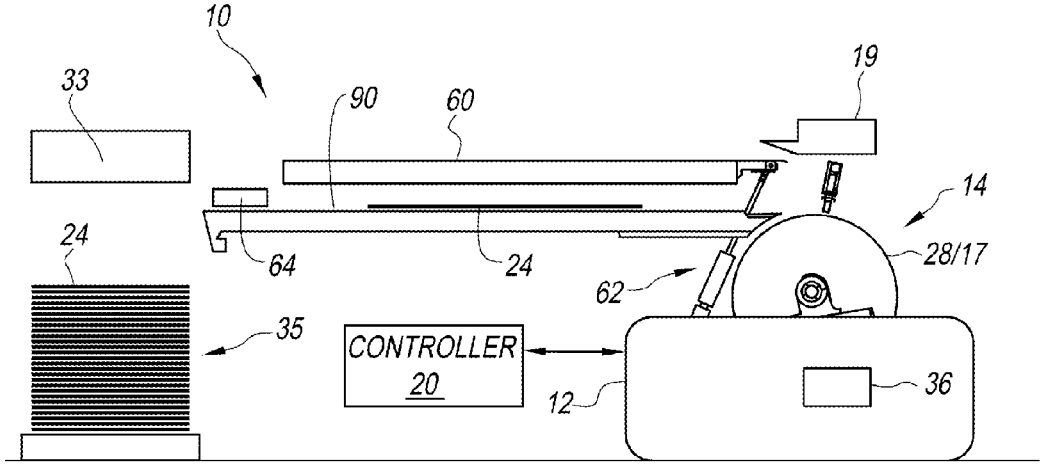
FIG. 3 shows an imaging apparatus according to an example embodiment of the invention.

The positioning of each of the frictional cells 122 is arranged according to a matrix grid coordinate system comprising five (5) rows identified by row index i=1, 2, 3, 4 and 5 and three (3) columns identified by column index j=1, 2, and 3. Accordingly, as shown in FIG. 2 the distance from pivot point 116 to a center of each frictional cell 122 is represented by distance $D_{i,j}$. For example, FIG. 2 shows that frictional forces $F_{FA}$ associated with each of a first frictional cell 122 (i.e. located by row index i=2 and column index j=2) and a second frictional cell 122 (i.e. located by row index i=5 and column index j=1) are spaced from pivot point 116 by distances $D_{2,2}$ and $D_{5,1}$. It is understood that other frictional cells 122 would be spaced from pivot point 116 in a similar manner.

The total frictional moment $M_{TOTA}$ that resist pivoting about pivot point 116 can be estimated by the following relationship:

$$M_{TOTA}=\Sigma D_{i,j}*F_{FA}, \text{ where } i=1, 2, 3, 4 \text{ and } j=1, 2 \text{ and } 3. \quad (2)$$

When this summation is completed for the previous example, the total frictional moment $M_{TOTA}$ is determined to be 0.475 Nm.

The magnitude of the plate movement force $F_A$ required to overcome the total frictional moment $M_{TOTA}$ and rotate printing plate 24C about pivot point 116 can be estimated from the following relationship:

$$F_A=M_{TOTA}/X; \text{ where;} \quad (3)$$

X is a moment length associated with the application of plate movement force $F_A$.

In this example X≃2*W or 0.38 m and the plate movement force $F_A$ is estimated to be equal to 1.06 N. A summation of forces shows that reaction force $R_A$ is equal to plate movement force $F_A$ (i.e. $R_A$=$F_A$=1.06 N).

Reaction forces $R_A$ of this magnitude can lead to formation of high contact stresses between registration pin 108 and the engaged edge portion of printing plate 24C. These contact stresses can lead to the formation undesired deformations in the engaged edge of printing plate 24C.

Further analysis of relationship (3) that plate movement force $F_A$ can be reduced by reducing frictional moment $M_{TOTA}$. Reductions in plate movement force $F_A$ in turn correspond to reductions in reaction force $R_A$.

The present invention has determined that the total frictional moment acting between a printing plate 24 and a surface onto which it is supported can be reduced by pivoting the printing plate 24 about a pivot point that is located at a different location than those of the application points of the various applied forces (e.g. applied force $F_A$ and reaction force $R_A$). The present invention has additionally determined that the total frictional moment acting between a printing plate 24 and a surface onto which it is supported can be reduced by pivoting the printing plate 24 about a pivot point that is positioned inboard from the perimeter of printing plate 24 as defined by its edges. In particular, the present invention has determined that the total frictional moment can be significantly reduced by pivoting the printing plate 24 about a pivot point that lies between the locations of the applied forces, especially in proximity to the geometric center of printing plate 24 or in the vicinity of the center of mass of the printing plate 24 or in the vicinity of a centroid of one or more areas of contact between the printing plate 24 and the support surface onto which it is pivoted.

Figure 7:
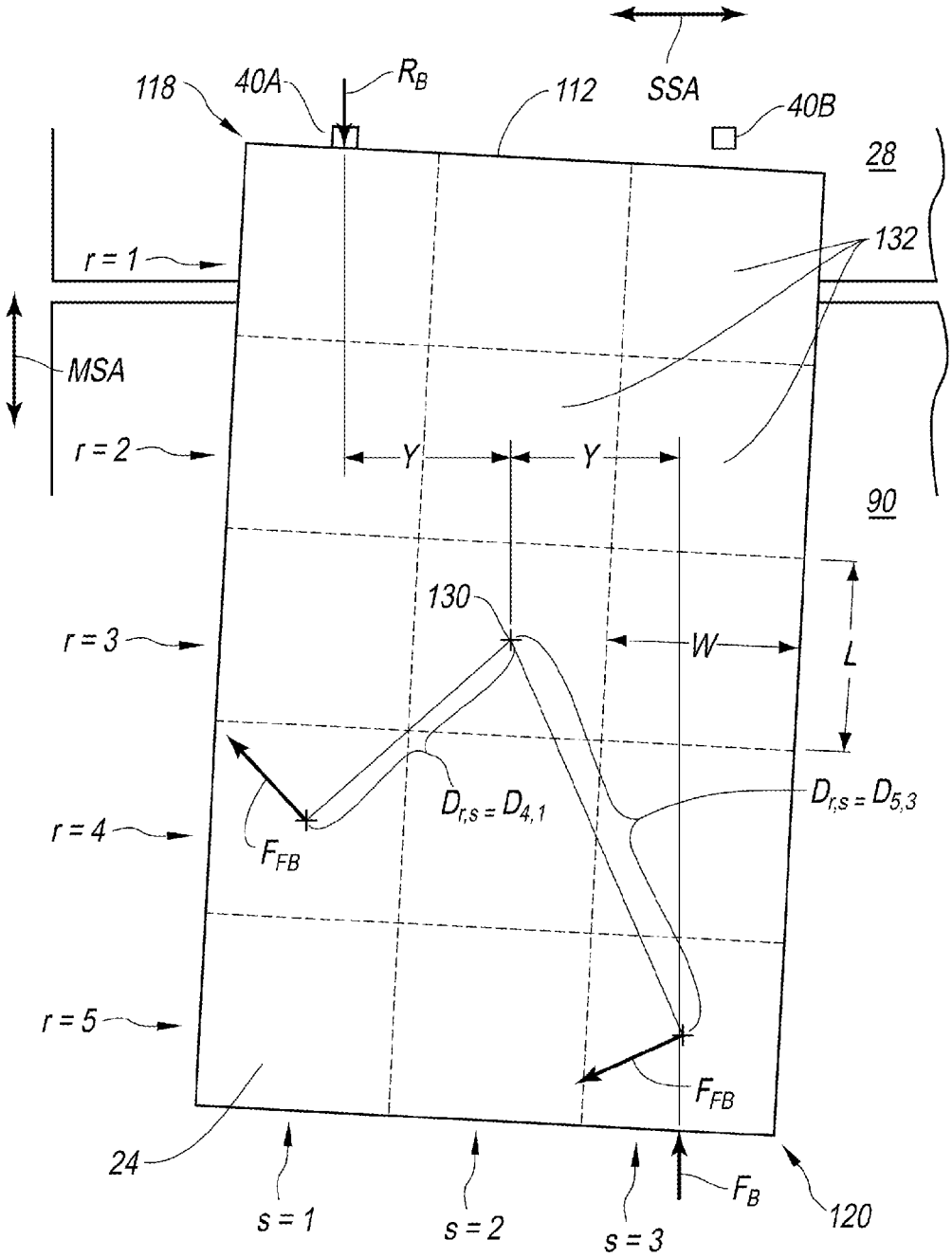
FIG. 7 shows a force diagram associated with the positioning of a printing plate in the imaging apparatus of FIGS. 3-6.

FIG. 7 shows a force diagram corresponding to printing plate 24C pivoted about a pivot point 130 positioned within the perimeter of printing plate 24C as per an example embodiment of the invention. In this illustrated embodiment, pivot point 130 is positioned substantially at a center of a surface of printing plate 24C. Printing plate 24C is substantially supported by support surface 90 which has substantially similar frictional characteristics to conventional support surface 102. Printing plate 24C is contacted by first registration member 40A at a point on the perimeter of the printing plate 24C in proximity to corner portion 118 of printing plate 24C. A reaction force $R_B$ is exerted by second registration member 40B on an edge portion of printing plate 24C. A plate movement force $F_B$ (e.g. as provided by plate positioning system 64) is also exerted on surface of printing plate 24C. In this illustrated embodiment, force $F_B$ is applied to an edge portion of printing plate 24C in proximity to corner portion 120 to provide a moment to pivot printing plate 24C about pivot point 130. In this illustrated embodiment, reaction force $R_B$ and plate movement force $F_B$ are applied to opposing edges of printing plate 24C at locations that are substantially similar to the locations of conventionally applied reaction force $R_A$ and plate movement force $F_A$ shown in FIG. 2. In this illustrated embodiment, neither of forces $F_B$ or $R_B$ is directly applied to locations on printing plate 24C that correspond to the location of pivot point 130.

Frictional characteristic between printing plate 24C and support surface 90 are again simulated by dividing printing plate 24C into fifteen (15) frictional cells 132. The number of frictional cells 132 employed in this simulation are again selected for illustration purposes only and those skilled in the art will realize that different numbers can also be employed. In this embodiment, frictional cells 132 are substantially the same in form as frictional cells 122 that were previously analyzed. The frictional force $F_{FB}$ associated with each friction cell 132 is therefore estimated by relationship (1).

In this example embodiment the frictional force acting on each frictional cell is determined to be $F_{FB}=F_{FA}=0.0573$ N for the following conditions: $\rho=2700$ kg/m$^3$, L=W=0.19 m, b=0.0002 m, g=9.81 m/S$^2$ and $\mu=0.3$ (i.e. assuming that the frictional characteristic of support surface 90 mimic those of conventional support surface 102).

The positioning of each of the frictional cells 132 is arranged according to a matrix grid coordinate system comprising five (5) rows identified row index r=1, 2, 3, 4 and 5 and three (3) columns identified by column index s=1, 2, and 3. Accordingly, as shown in FIG. 7 the distance from pivot point 130 to a center of each frictional cell 132 is represented by distance $D_{r,s}$. Frictional forces $F_{FB}$ associated with each frictional cell 132 are shown working at distances $D_{r,s}$ associated with each of the cells 132. For example, FIG. 7 shows that frictional forces $F_{FB}$ associated with each of a first frictional cell 132 (i.e. located by row index r=4 and column index s=1) and a second frictional cell 132 (i.e. located by row index r=5 and column index s=3) are spaced from pivot point 130 by distances $D_{4,1}$ and $D_{5,3}$ respectively. It is understood that other frictional cells 132 would be spaced from pivot point 130 in a similar manner. The total frictional moment $M_{TOTB}$ that resists pivoting about pivot point 130 can be estimated by the following relationship:

$$M_{TOTB}=\Sigma D_{rs}*F_{FB}, \text{ where } r=1, 2, 3, 4 \text{ and } 5, \text{ and } s=1, 2 \text{ and } 3. \quad (4)$$

When this summation is completed for the previous example, the total frictional moment $M_{TOTB}$ is determined to be 0.248 Nm or about half of the total frictional moment $M_{TOTA}$ that was previously calculated for the conventional pivoting arrangement.

The magnitude of the plate movement force $F_B$ required to overcome the total frictional moment $M_{TOTB}$ and rotate printing plate 24C about pivot point 130 can be estimated from the following relationship:

$$F_B=(M_{TOTB}=(R_B*Y))/Y; \text{ where:} \quad (5)$$

Y is a moment length associated with the application of each of plate movement force $F_B$ and reaction force $R_B$ about pivot point 130.

A summation of forces shows that plate movement force $F_B$ is substantially equal to reaction force $R_B$ and therefore relationship (5) can be rewritten as:

$$F_B=M_{TOTB}/2Y. \quad (6)$$

In this example $Y\simeq 1*W$ or 0.19 m and the plate movement force $F_B$ is estimated to be equal to 0.55N. Accordingly, and reaction force $R_B$ is also substantially equal to 0.55N or about half of the reaction force $R_A$ that was calculated previously for the conventional plate pivoting scenario. This reduced reaction force $R_B$ can be used to help reduce the chances of inflicting undesired deformations on an edge of printing plate 24C.

As shown in FIG. 7, proper registration of printing plate 24C requires contact between its registration edge 112 and both the first registration member 40A and second registration member 40B. Conventional techniques for pivoting a supported printing plate about a pivot point located inboard of the printing plate's perimeter are taught in U.S. Pat. No. 6,662,725 (Koizumi et al.). Koizumi et al. teaches the use of a holding device (e.g. a suction feature) located on the support surface onto which the printing plate is positioned. The holding device applies a holding force directly to the point on a supported surface of the printing plate about which the plate is pivoted. Koizumi et al. additionally teaches the use of a blunt member for pressing the printing plate against the support surface at a point inboard of its perimeter. In this case the printing plate is pivoted about a point on the printing plate contacted by the blunt member. Although these conventional techniques teach pivoting a printing plate 24 about fixed inboard pivot point, they would not be suitable for maintaining contact between an initially engaged registration member and a registration edge of the printing plate 24 since pivoting the printing plate 24 to engage a second registration member would cause a separation between the initially engaged registration member and the registration edge.

Figure 8A:
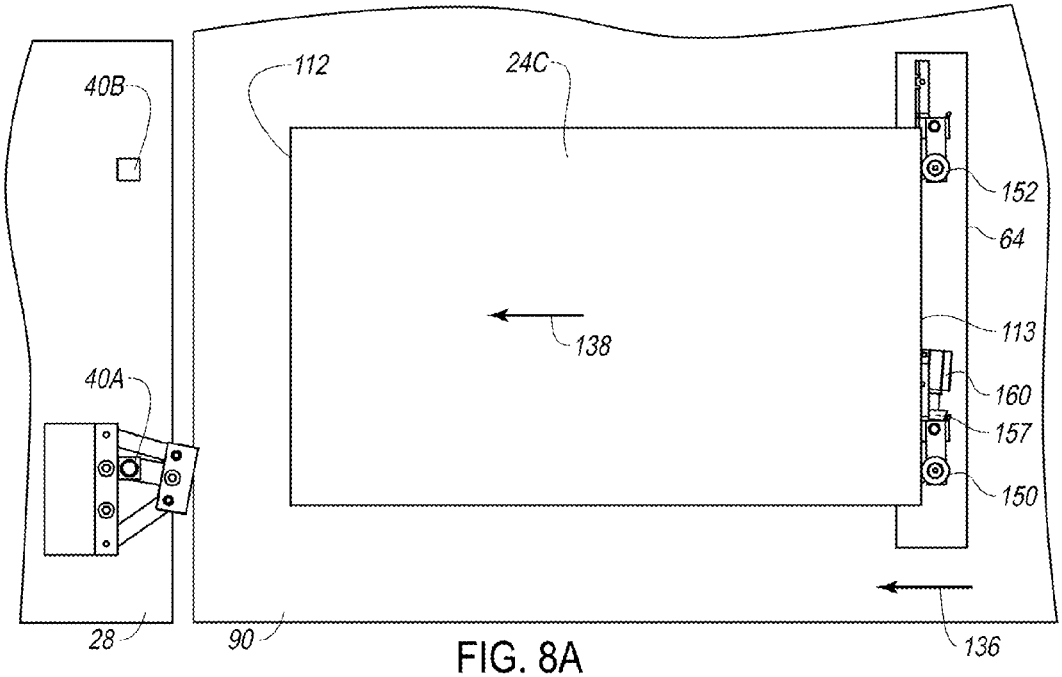
FIGS. 8A-8D show a sequence of movements for registering a printing plate against first and second registration members as per a method practiced in accordance with an example embodiment of the invention.

FIGS. 8A-8D show a sequence of movements for registering printing plate 24C against first and second registration member 40A and 40B as per a method practiced in accordance with an example embodiment of the invention. As shown in FIG. 8A, printing plate 24C is substantially supported on support surface 90. First and second registration members 40A and 40B are coupled to imaging support surface 28. In this illustrated embodiment, second registration member 40B which is fixedly coupled to imaging support surface 28 and first registration member 40A is movably coupled to imaging support surface 28. Both first and second registration members 40A and 40B are arranged along a direction that intersects a direction of movement of printing plate 24C over support surface 90.

It is desired that printing plate 24C be transferred from support surface 90 to imaging support surface 28 such that the registration edge 112 of printing plate 24C is registered against first and second registration members 40A and 40B. In this example embodiment, second registration member 40B is contacted by registration edge 112 after first registration member 40A is contacted by registration edge 112.

Figure 9A:
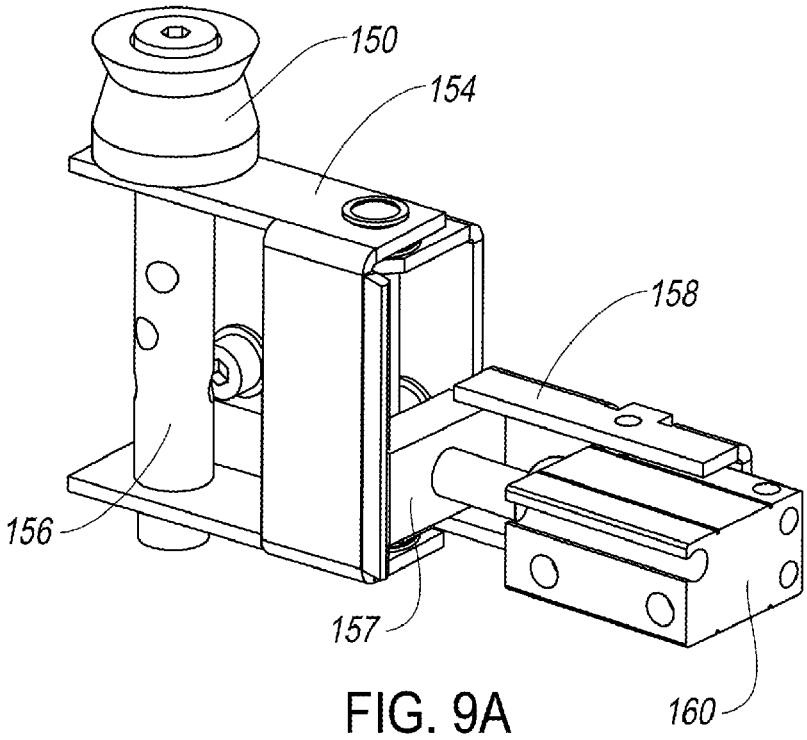
FIG. 9A shows a perspective view of a first conveying member employed in an example embodiment of the invention.
Figure 9B:
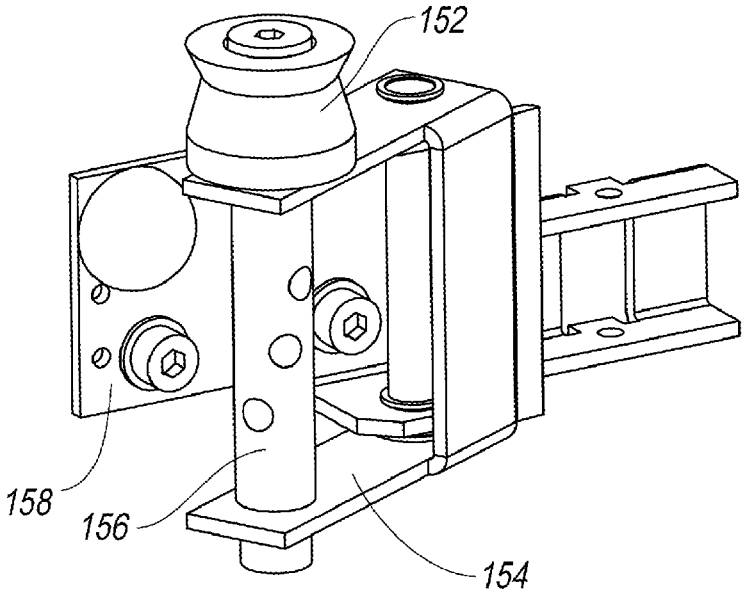
FIG. 9B shows a perspective view of a second conveying member employed in an example embodiment of the invention.

Plate positioning system 64 includes a first conveying member 150 and a second conveying member 152 which are adapted to engage edge 113 of printing plate 24C. In this illustrated embodiment, edge 113 opposes registration edge 112. First and second conveying members 150 and 152 are substantially identical in shape and form in this example embodiment. FIG. 9A shows a detailed perspective view of first conveying member 150 and an associated mechanism. FIG. 9B shows a detailed perspective view of second conveying member 152 and an associated mechanism. Each of first and second conveying members 150 and 152 comprises various frusto-conical shapes adapted to engage an edge portion of printing plate 24C. Each of first and second conveying members 150 and 152 is further adapted to rotate about shaft 156 which can allow each of the conveying members to move in a rolling fashion along an engaged edge portion of printing plate 24C. Each of first and second conveying members 150 and 152 is pivotally attached to a base member 158 by hinged member 154. Although each of first and second conveying members 150 and 152 each include frusto-conical shaped portions which can lead to the generation of high contact stresses with engaged edge 113 of printing plate 24C, edge 113 is not subsequently used for registration purposes and is thus tolerant of any edge deformations that may arise from these contact stresses. Nonetheless, other example embodiments of the invention can employ conveying members with other shapes and forms. For some applications, one or both of first and second conveying members 150 and 152 may comprise shapes or sizes suitable for reducing contact stresses in an engaged edge.

Each of first and second conveying members 150 and 152 is pivotally movable to various locations between the two positions shown in FIGS. 9A and 9B. FIG. 9A shows a default "closed" position. FIG. 9B shows an "open" position. A biasing element (not shown) is adapted to move first conveying member 150 towards the closed position when first conveying member 150 is not engaged with a portion of edge 113. Suitable biasing elements can include helical or torsion springs for example. An additional actuator 160 is provided to lock first conveying member 150 in the closed position with a locking member 157. Actuator 160 can include a pneumatic or hydraulic cylinder, or an electric solenoid for example. First conveying member 150 can be pivotally moved towards the open position when actuator 160 is unlocked. In this example embodiment, second conveying member 152 is adapted to move in a similar fashion. However, unlike first conveying member 150, second conveying member 152 is not lockable in the closed position and therefore is not coupled to an actuator such as actuator 160.

Figure 8B:
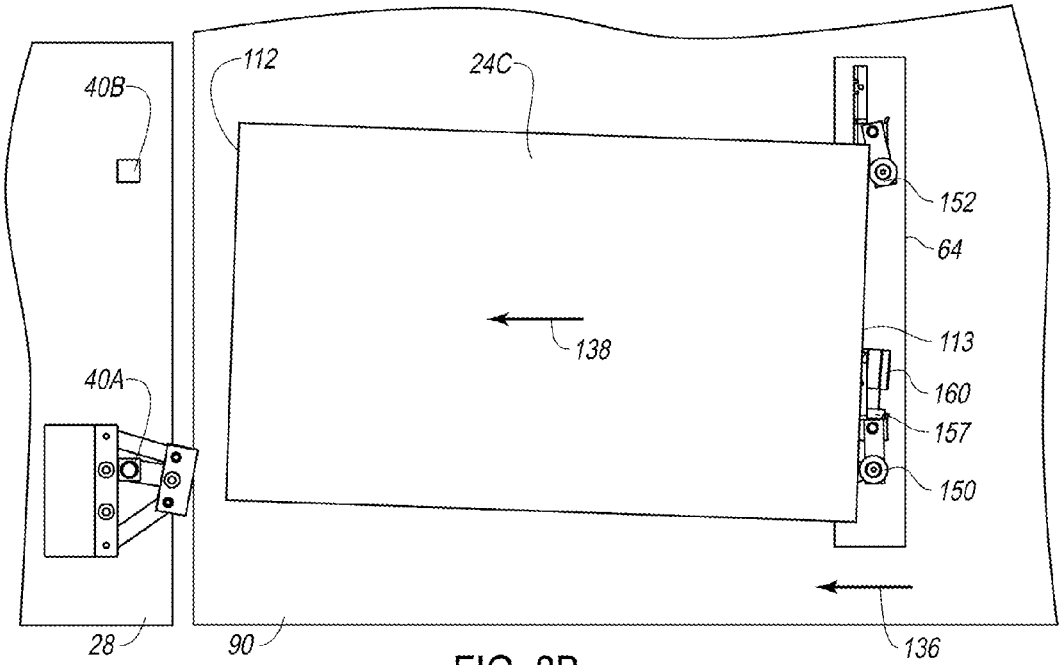

As shown in FIG. 8A, plate positioning system 64 is moved along a direction 136 to cause contact between first and second conveying members 150 and 152 and respective portions of edge 113 of printing plate 24C. In this example embodiment, actuator 160 is activated to extend locking member 157 to lock first conveying member 150 in its closed position. As shown in FIG. 8B, as printing plate 24C is moved along a first direction 138 by plate positioning system 64, frictional forces between printing plate 24C and support surface 90 cause printing plate 24C to pivot and cause second pivoting member 152 to move towards it open position. In this illustrated embodiment printing plate 24C accordingly assumes a pre-skewed orientation as it is moved along first direction 138 of a path over support surface 90. In this illustrated embodiment, printing plate 24C assumes a pre-skewed orientation prior to engagement with any of the first and second registration members 40A and 40B. Pre-skewing a printing plate 24 to reposition it from a first orientation on the support surface 90 to a second orientation can be used to improve the efficiency of the registration process. For example, different printing plates 24 can be each positioned with different first orientations on support surface 90 for numerous reasons including positional inaccuracies associated with their initial placement on the support surface 90. Pre-skewing these printing plates 24 to a substantially common second orientation prior to their engagement with a set of registration members can be used to reduce the time required to subsequently move each of the printing plates 24 into proper engagement with each of the registration members.

Figure 10:
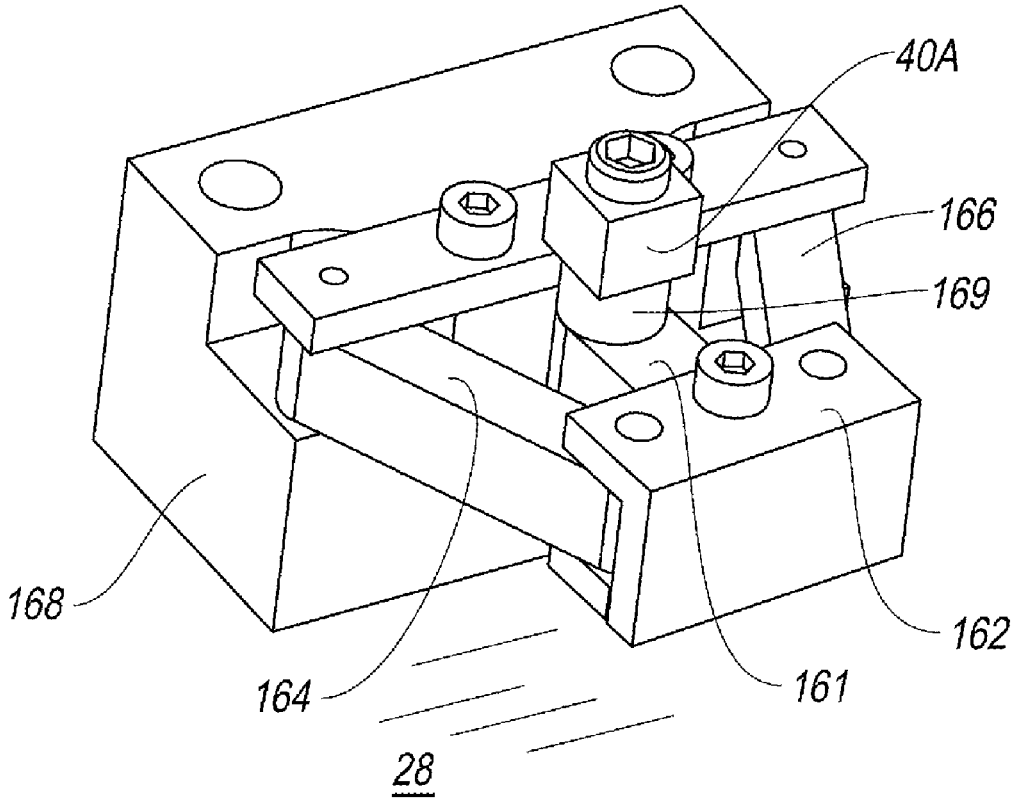
FIG. 10 shows a perspective view of a registration member employed in an example embodiment of the invention.

FIG. 10 shows a perspective view of first registration member 40A and associated mechanism adapted to permit relative movement between first registration member 40A and imaging support surface 28. The associated mechanism is a straight line linkage that allows first registration member 40A to move along a substantially straight line. Straight line linkages can include different suitable configurations. In this example embodiment, a four-bar linkage typically referred to as "Robert's Straight Line Linkage" is employed. Essentially, first registration member 40A is pivotally attached via shaft 169 to an extension member 161 protruding from a connecting member 162 which is connected to two equally sized pivot members 164 and 166. Pivot members 164 and 166 are pivotally connected to base member 168 which is in turn attached to imaging support surface 28. Pivot members 164 and 166 are preferably separated from one another at base member 168 by a distance equal to twice the length of connecting member 162. In this configuration, first registration member 40A is adapted to move along a substantially straight line while it rotates about an axis of shaft 169.

Figure 8C:
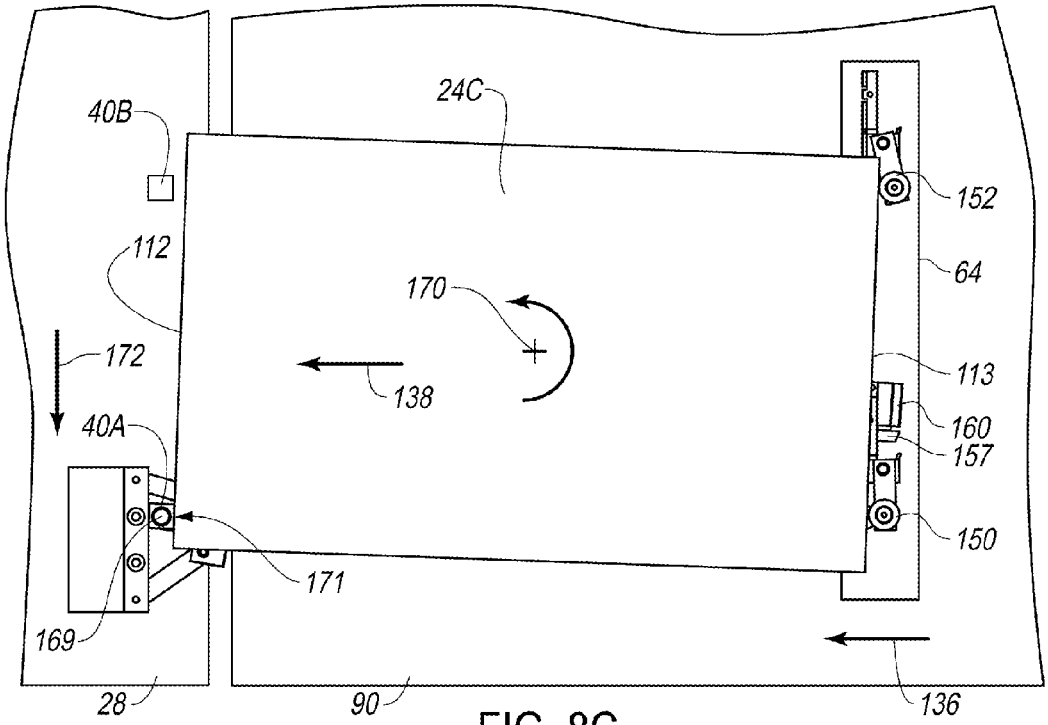

As printing plate 24C is moved along first direction 138, contact is established between first registration member 40A and registration edge 112 at a contact position as shown in FIG. 8C. A biasing member (not shown) is employed to bias the straight line linkage mechanism in an orientation suitable for contact with the pre-skewed printing plate 24C. Suitable biasing members can include helical or torsion springs for example. At the contact position, actuator 160 is activated to retract locking member 157 and unlock first conveying member 150. Various sensors (not shown) can be used to detect the occurrence of contact between registration edge 112 and first registration member 40A. In some example embodiments, the load on a drive (not shown) that is operated to move plate positioning system 64 is monitored, and actuator 160 is appropriately activated when this load reaches a level indicative of contact with first registration member 40A.

As plate positioning system 64 continues to move printing plate 24C along first direction 138, first registration member 40A applies a reaction force to registration edge 112 which alters the movement of printing plate 24C along first direction 138. In this illustrated embodiment, printing plate 24C pivots about a pivot point 170 located on a surface of printing plate 24C that is substantially supported on support surface 90. Specifically, the location of pivot point 170 is inboard from the perimeter of the supported surface of printing plate 24C. In this illustrated embodiment, pivot point 170 is located on a portion of the printing plate that is not directly physically secured to, or constrained by support surface 90. That is, the portion of printing plate 24C in which pivot point 170 is located is separable from support surface 90.

As printing plate 24C pivots about pivot point 170, each of second conveying member 152 and unlocked first conveying member 150 maintain their contact with edge 113. In this illustrated embodiment, second conveying member 152 and unlocked first conveying member 150 move closer relative to one another as they pivot via their hinged members 154 to maintain contact with edge 113. In this illustrated embodiment, each of second conveying member 152 and unlocked first conveying member 150 are adapted to roll along edge 113 as printing plate 24C is pivoted. In some embodiments, each of second conveying member 152 and unlocked first conveying member 150 move with the same rotational direction. In some example embodiments, second conveying member 152 and unlocked first conveying member 150 can move in opposite directions as printing plate 24C is pivoted.

As printing plate 24C pivots about pivot point 170, first registration member 40A maintains contact with registration edge 112. In this illustrated embodiment, initial contact is established between first registration member 40A and printing plate 24C at a contact location 171 on registration edge 112 and this contact location 171 does not substantially change as printing plate 24C is pivoted. That is, there is substantially no relative movement between first registration member 40A and the contacted registration edge 112 as printing plate 24C is pivoted about pivot point 170. In this illustrated embodiment, first registration member 40A moves along substantially a straight path along a second direction 172 that intersects first direction 138 as printing plate 24C is pivoted. The movement of first and second conveying members 150 and 152 against edge 113 cause a reaction force to be created between first registration member 40A and a contacted portion of registration edge 112 which in turn causes first registration member 40A to move under the influence of the generated reaction force. In this illustrated embodiment, first registration member 40A commences moving after it has contacted registration edge 112. In this illustrated embodiment, first registration member 40A moves along second direction 172 away from second registration member 40B as printing plate 24C pivots. First registration member 40A can rotate about shaft 169 to maintain contact with registration edge 112 as printing plate 24C is pivoted. A rotation axis of first registration member 40A intersects a plane of support surface 90 in this example embodiment. In this example embodiment, first registration member 40A moves along a path defined by the straight line linkage it is coupled to. In other embodiments, first registration member 40A can move along other paths in conjunction with constraints imposed by other linkages or guide mechanisms.

Figure 8D:
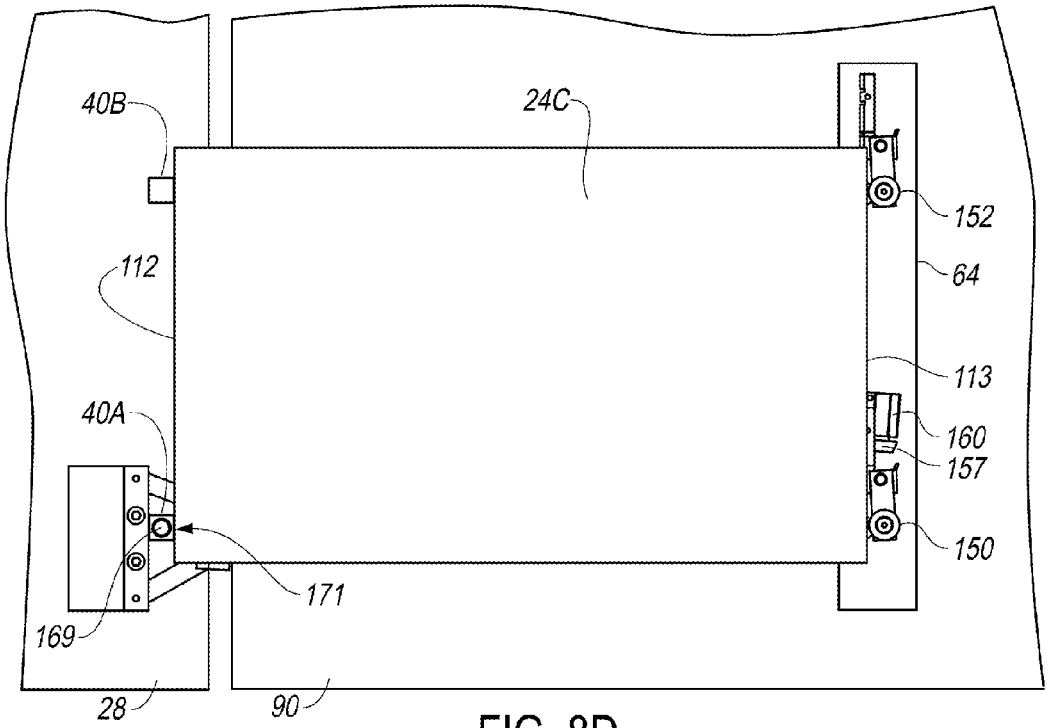

First conveying member 150, second conveying member 152 and first registration member 40A each move in a way that allows printing plate 24C to pivot about inboard pivot point 170 to a desired registered position in which contact with second registration member 40B is additionally established as shown in FIG. 8D. Since pivot point 170 is located at a position on printing plate 24C different than the locations to which forces are directly applied by each of first conveying member 150, second conveying member 152 and first registration member 40A, the magnitude of these applied forces can be reduced over conventional registration methods.

The position of inboard pivot point 170 may vary slightly as printing plate 24C is pivoted on support surface 90. Slight variations can occur for various reasons which in this illustrated embodiment can include deviations in the approximated straight line path that first registration member 40A is constrained to move along by the employed straight line linkage. Nonetheless, these minor deviations still maintain pivot point 170 within the perimeter of printing plate 24C and still advantageously allow for reduced registration forces.

The position of inboard pivot 170 can vary among different printing plates 24, especially if the printing plates have different sizes. The printing plates 24 can be differently sized along their registration edges and/or lateral edges for example. This effect can be observed when different sized printing plates 24 are sequentially registered against the first and second registration members 40A and 40B. The distance between each of the respective pivot points and contacted first registration member 40A can be seen to vary when each differently sized printing plate 24 is pivoted to a common position in which both of the first and second registration members 40A and 40B are contacted. In some embodiments of the invention each of the differently sized printing plates 24 include an inboard pivot point.

In this illustrated embodiment, each of first registration member 40A and second registration member 40B includes a substantially planar surface adapted to further reduce contact stresses when contacted by associated portions of registration edge 112 in addition to the reduced applied forces. Other example embodiments of the invention may employ registration members that have other forms of contact surfaces.

Figure 11A:
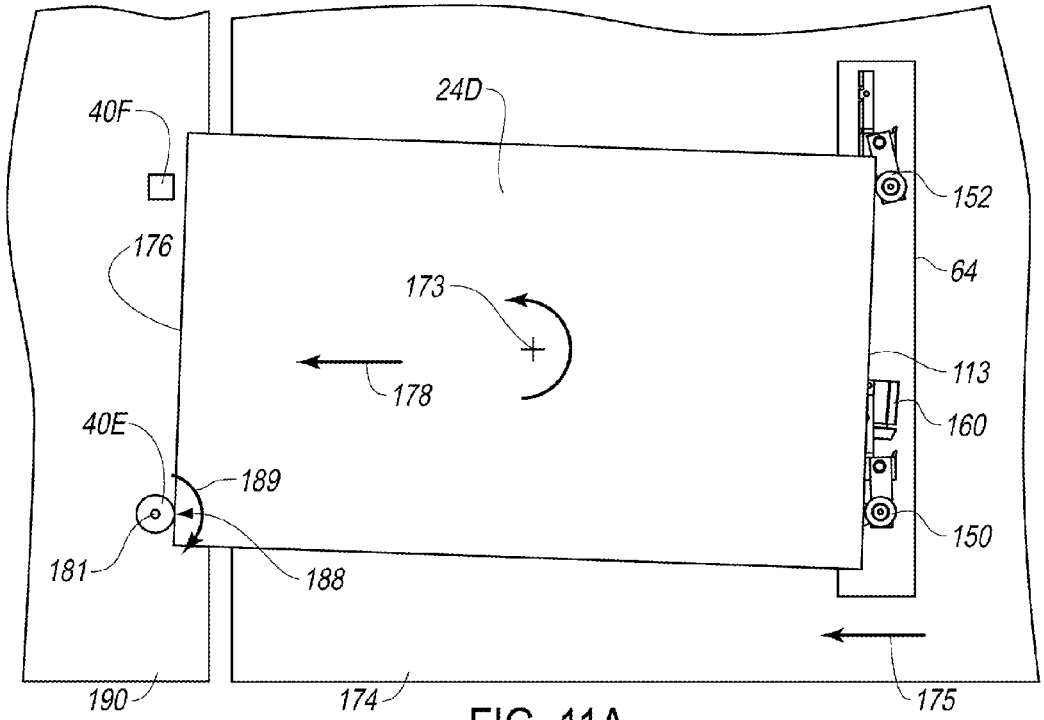
FIGS. 11A and 11B show a sequence of movements for registering a printing plate against first and second registration members as per a method practiced in accordance with an example embodiment of the invention.

In an example embodiment of the invention shown in FIG. 11A, a printing plate 24D is a moved along a first direction 178 over a support surface 174 as plate positioning system 64 is moved along direction 175. Printing plate 24D is additionally pivoted about an inboard pivot point 173 while supported on support surface 174. Printing plate 24D is shown engaged by first and second conveying members 150 and 152 in a manner similar to other various embodiments of the invention. A registration edge 176 of printing plate 24D is also contacted by a first registration member 40E. In this example embodiment first registration member 40E includes a low friction rolling element (e.g. a ball bearing) adapted to rotate about a fixed shaft 181 and accordingly has a rotating cylindrical contact surface. In this example embodiment, shaft 181 is fixedly attached to a second support surface 190. It is desired that registration edge 176 be registered against first registration member 40E and second registration member 40F.

Figure 11B:
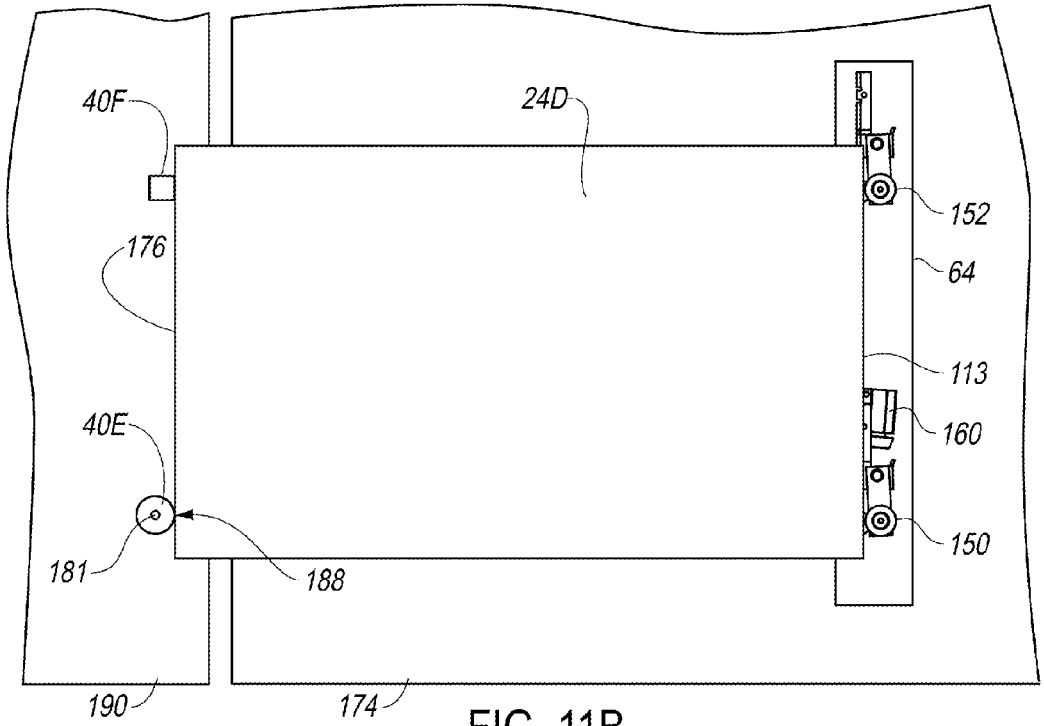

In this illustrated embodiment, movement of first registration member 40E is substantially confined to rotate only about shaft 181. As shown in FIG. 11A, first registration member 40E is shown rotating along second direction 189 as printing plate 24D is pivoted about pivot point 173. As printing plate 24D is pivoted on support surface 174, contact between printing plate 24D and each of first conveying member 150, second conveying member 152 and first registration member 40E is maintained. However, as shown in FIGS. 11 A and 11B, a contact location 188 between registration edge 176 and first registration member 40E changes as the printing plate 24D is pivoted about pivot point 173. In this illustrated embodiment, movement of registration edge 176 against first registration member 40E causes first registration member 40E to rotate about its fixed axis about second direction 189 to change the location of contact between first registration member 40E and registration edge 176. In this illustrated embodiment, relative movement tangential to registration edge 176 is created between first registration member 40E and printing plate 24D.

Pivot point 173 remains inboard of the perimeter of printing plate 24D throughout this motion thereby advantageously allowing for reduction in the applied forces required to register printing plate 24D. In this example embodiment, pivot point 173 will translate relatively between printing plate 24D and support surface 174 but will remain positioned within the perimeter of printing plate 24D as printing plate 24 is pivoted to contact second registration member 40F. A component of this movement can be parallel to first direction 178.

In this illustrated embodiment, reduced edge deformations in printing plate 24D can be achieved by a combination of the relatively large sized rotating cylindrical contact surface of first registration member 40E and the reduced loading that accompanies the inboard pivoting.

The invention has been described in detail with particular reference to certain preferred embodiments thereof, but it will be understood that variations and modifications can be effected within the scope of the invention.

PARTS LIST

10 imaging apparatus
12 frame
14 image recording system
17 plate exchange surface
19 punch system
20 controller
22 imaging head
24 printing plates

24A first printing plate
24B second printing plate
24C printing plate
24D printing plate
25A lateral edge
25B lateral edge
28 imaging support surface
30 light emission channel source
32 light emission channel source
33 plate handling mechanism
34 exterior surface
35 printing plate stack
36 motor
38 threaded screw
40A first registration member
40B second registration member
40C first registration member
40D second registration member
40E first registration member
40F second registration member
52 registration edge
54 registration edge
60 transfer support surface
62 positioning system
64 plate positioning system
90 support surface
100 conventional printing plate positioning apparatus
102 support surface
104 plate positioning system
106 imaging support surface
108 registration pin
110 registration pin
111 direction
112 registration edge
113 edge
114 registration pin axis
116 pivot point
118 corner portion
120 corner portion
122 frictional cell
130 pivot point
132 frictional cell
136 direction
138 first direction
150 first conveying member
152 second conveying member
154 hinged member
156 shaft
157 locking member
158 base member
160 actuator
161 extension member
162 connecting member
164 pivot member
166 pivot member
168 base member
169 shaft
170 pivot point
171 contact location
172 second direction
173 pivot point
174 support surface
175 direction
176 registration edge
178 first direction
181 shaft
188 contact location
189 second direction
190 second support surface
i row index
j column index
r row index
s column index
$D_{i,j}$ distance
$D_{r,s}$ distance
$F_A$ plate movement force
$F_B$ plate movement force
$F_{FA}$ frictional force
$F_{FB}$ frictional force
L first size of a frictional cell
W a second size of a frictional cell
$M_{TOTA}$ total frictional moment
$M_{TOTB}$ total frictional moment
MSA main scanning axis
SSA sub-scanning axis
$R_A$ reaction force
$R_B$ reaction force
X moment length
Y moment length

The invention claimed is:

1. A method for registering a printing plate, comprising:
supporting the printing plate on a support surface;
providing a plurality of registration members adapted to register an edge of the printing plate;
moving the printing plate over the support surface along a first direction to a position where the edge of the printing plate contacts a first registration member of the plurality of registration members;
moving the first registration member along a second direction that intersects the first direction while maintaining contact between the first registration member and the edge of the printing plate at a location on the edge that does not substantially vary as the first registration member moves along the second direction;
establishing contact between the printing plate and a second registration member of the plurality of registration members after the first registration member has commenced moving along the second direction;
wherein establishing contact between the printing plate and the second registration member of the plurality of registration members after the first registration member has commenced moving along the second direction comprises establishing contact between the edge of the printing plate and the second registration member; and
comprising moving the first registration member along the second direction away from the second registration member.

2. A method according to claim 1, wherein the edge of the printing plate extends along a direction that intersects the first direction and the second direction when the printing plate is positioned at a position where the edge of the printing plate first contacts the first registration member.

3. A method according to claim 1, comprising commencing the movement of the first registration member when the first registration member is first contacted by the edge of the printing plate.

4. A method according to claim 1, comprising an imaging support surface adapted to support the printing plate while forming images thereon, and the method comprises transferring the printing plate from the support surface to the imaging support surface.

5. A method according to claim 1, wherein the first registration member and the second registration member are arranged along a line extending along a direction that intersects the first direction.

6. A method for registering a printing plate, comprising:

supporting the printing plate on a support surface;

providing a plurality of registration members adapted to register an edge of the printing plate;

moving the printing plate over the support surface along a first direction to a position where the edge of the printing plate contacts a first registration member of the plurality of registration members;

moving the first registration member along a second direction that intersects the first direction while maintaining contact between the first registration member and the edge of the printing plate at a location on the edge that does not substantially vary as the first registration member moves along the second direction;

establishing contact between the printing plate and a second registration member of the plurality of registration members after the first registration member has commenced moving along the second direction;

wherein establishing contact between the printing plate and the second registration member of the plurality of registration members after the first registration member has commenced moving along the second direction comprises establishing contact between the edge of the printing plate and the second registration member; and wherein the first registration member and the second registration member are each coupled to the imaging support surface.

7. A method for registering a printing plate, comprising:

supporting the printing plate on a support surface;

providing a plurality of registration members adapted to register an edge of the printing plate;

moving the printing plate over the support surface along a first direction to a position where the edge of the printing plate contacts a first registration member of the plurality of registration members;

moving the first registration member along a second direction that intersects the first direction while maintaining contact between the first registration member and the edge of the printing plate at a location on the edge that does not substantially vary as the first registration member moves along the second direction;

establishing contact between the printing plate and a second registration member of the plurality of registration members after the first registration member has commenced moving along the second direction;

wherein establishing contact between the printing plate and the second registration member of the plurality of registration members after the first registration member has commenced moving along the second direction comprises establishing contact between the edge of the printing plate and the second registration member; and comprising moving the first registration member along the line away from the second registration member.

* * * * *